US005651583A

United States Patent [19]

Klingler et al.

[11] Patent Number: 5,651,583

[45] Date of Patent: Jul. 29, 1997

[54] SEAT BACK REST WITH AN ADJUSTMENT DEVICE FOR A FLEXIBLE ARCHING ELEMENT FOR ADJUSTING THE CONVEX CURVATURE OF THE BACK REST

[75] Inventors: Knud Klingler, Nürnberg, Germany; Paul Rozaitis, Toronto, Canada

[73] Assignee: AMEU Management Corp., Panama, Panama

[21] Appl. No.: 407,007

[22] PCT Filed: Sep. 10, 1993

[86] PCT No.: PCT/EP93/02457

§ 371 Date: May 1, 1995

§ 102(e) Date: May 1, 1995

[87] PCT Pub. No.: WO94/07393

PCT Pub. Date: Apr. 14, 1994

[30] Foreign Application Priority Data

Sep. 29, 1992 [DE] Germany ..... 42 32 679.6

[51] Int. Cl.[6] ..... A47C 3/025

[52] U.S. Cl. ..... 297/284.4; 397/284.1

[58] Field of Search ..... 297/284.4, 284.6, 297/284.1, 284.7, 284.8, 284.2

[56] References Cited

U.S. PATENT DOCUMENTS

| | | | |
|---|---|---|---|
| 1,182,854 | 5/1916 | Poler | 297/284.4 |
| 2,756,809 | 7/1956 | Endresen | 297/284.8 X |
| 4,316,631 | 2/1982 | Lenz et al. | 297/284.4 |
| 4,354,709 | 10/1982 | Schuster | 297/284.4 X |
| 4,810,033 | 3/1989 | Kemmann | 297/284.4 |
| 4,832,400 | 5/1989 | Aoki et al. . | |
| 4,880,271 | 11/1989 | Graves | 297/284.4 |
| 4,940,284 | 7/1990 | Nagasaka . | |
| 4,944,554 | 7/1990 | Gross et al. . | |
| 5,050,930 | 9/1991 | Schuster et al. | 297/284.4 |
| 5,076,643 | 12/1991 | Colasanti et al. | 297/284.6 |
| 5,197,780 | 3/1993 | Coughlin | 297/284.4 X |
| 5,217,278 | 6/1993 | Harrison et al. | 297/284.4 X |
| 5,449,219 | 9/1995 | Hay et al. | 297/284.4 |

FOREIGN PATENT DOCUMENTS

| | | |
|---|---|---|
| 1588711 | 10/1976 | European Pat. Off. . |
| 1914154 | 6/1971 | Germany . |
| 2724725 | 12/1977 | Germany . |
| 419714 | 4/1991 | Germany . |

*Primary Examiner*—Milton Nelson, Jr.
*Attorney, Agent, or Firm*—Harness, Dickey & Pierce, P.L.C.

[57] ABSTRACT

A seat back rest with an adjustment device for a flexible arching element (5) arranged on a frame (1) for adjusting the convex curvature of the back rest. According to the seat back rest, it has an additional pelvic support (17) connected to the flexible arching element (5), the pelvic support (17) being composed of an attachment (16, 23, 28) to the flexible arching element (5) directed towards the seat.

11 Claims, 3 Drawing Sheets

SEAT BACK REST WITH AN ADJUSTMENT DEVICE FOR A FLEXIBLE ARCHING ELEMENT FOR ADJUSTING THE CONVEX CURVATURE OF THE BACK REST

BACKGROUND OF THE INVENTION

The invention relates to a seat back rest with an adjustment device for a resilient arching element for adjusting the convex curvature of said back rest.

FIELD OF THE INVENTION

Such adjustable back rests are widely known, such as from U.S. Pat. No. 5,050,930, for example. They are all based on the principle of providing the back rest with a convex curvature adapted to the person sitting on the seat so that that person is provided with an ergonomically correct support in the area of the spinal column. Various systems are known, by which the convex curvature may be adjusted from a shallow to deep curve, however there are also systems in which the position of the peak of the curve adjusted selectively from shallow to deep may be moved upwards or downwards along the length of the seat. Back rests with adjustable convex curvature are also referred to as lumbar supports.

A common feature of these known adjustable back rests is that, in particular when the convex curvature is adjusted to be severe, a free unsupported area is left in the pelvic region and this causes the person problems after long periods in sitting position.

A seat is known from U.S. Pat. No. 4,832,400, which has a back rest with a separately pivoted hip support arranged in the lower area of the back rest. A corresponding hip support is known from U.S. Pat. No. 4,940,284 which is fully integrated into the back rest. Adjustment of the back rest is not provided for in these seats.

A seat with a back rest is known from U.S. Pat. No. 4,944,554, which has a plurality of plates arranged one above the other over the entire height of the back rest and flexibly connected to one another by means of bands, said plates being arranged to be individually adjusted, either manually or automatically, by means of adjustment devices attached to each individually, so that the back rest may be given almost any desired profile. This back rest is extremely complicated and very expensive to manufacture as well as requiring a great deal of effort for adjustment.

SUMMARY OF THE INVENTION

The object of the invention is to improve an adjustable seat back rest of the aforementioned type in such a way as to ensure that the back, in particular the pelvis, is also adequately supported directly underneath the curved area of the back rest, which, according to a further object of the invention, also has a simple structure and is therefore inexpensive to manufacture as well as being simple to adjust without requiring special effort for different users.

This object is achieved by a back rest with an adjustment device for a resilient arching element arranged on a frame for adjusting the convex curvature of said back rest, characterized in that it has an additional pelvic support connected to said resilient arching element, said pelvic support being composed of an attachment to said resilient arching element directed towards said seat.

BRIEF DESCRIPTION OF THE DRAWINGS

The invention is explained in more detail below on the basis of examples with reference to the drawings.

DETAILED DESCRIPTION OF THE PREFERRED EMBODIMENTS

Figure 2:
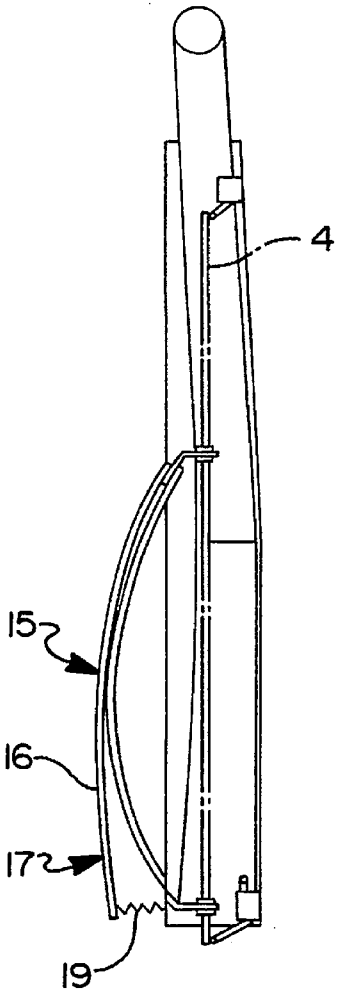
FIG. 2 shows a lateral view of the same as FIG. 1.
Figure 1:
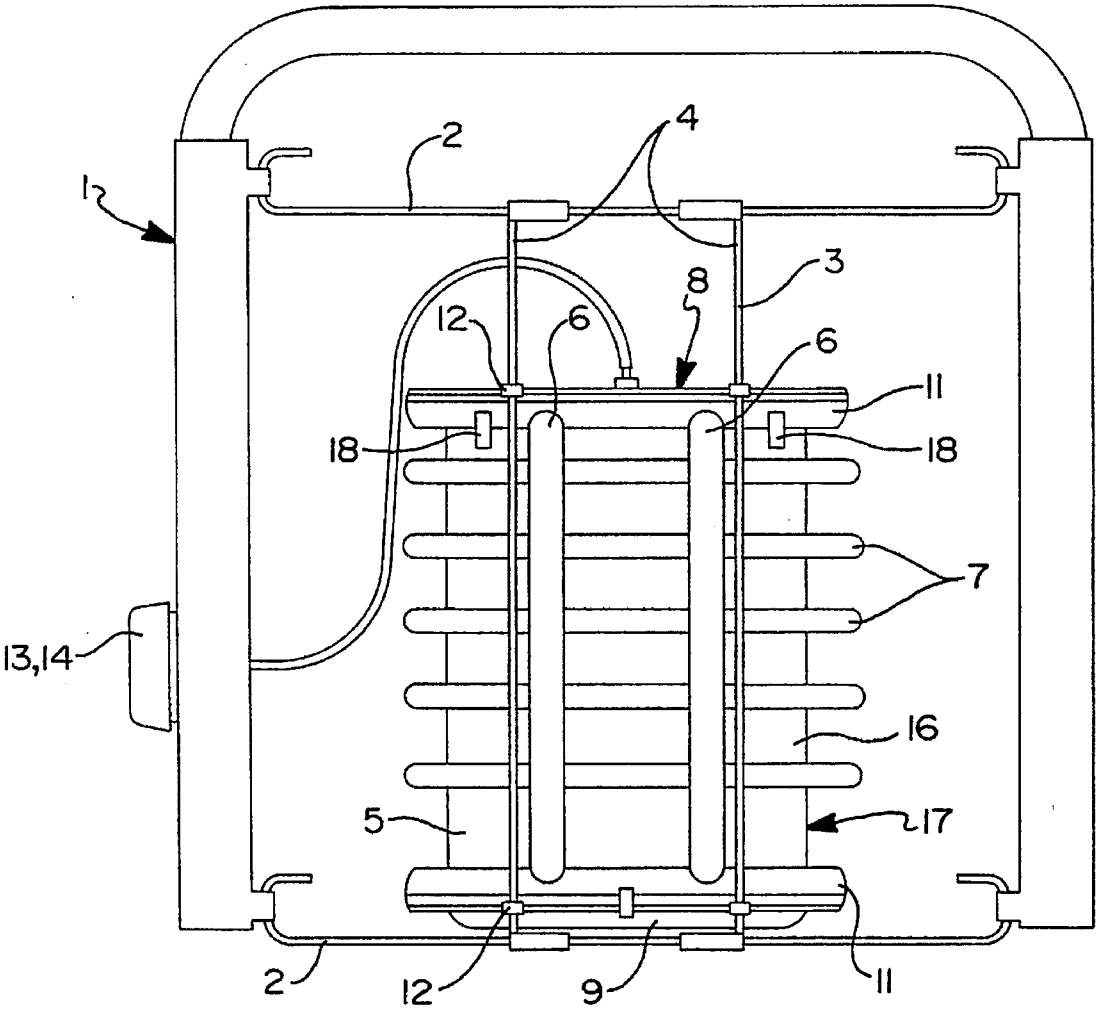
FIG. 1 shows a rear view onto a back rest with an arching device and a pelvic support secured in the area above the peak of the curve.

A back rest, as shown in FIGS. 1 and 2, is provided with a frame 1 with two transverse struts 2 and a guide means 3. The guide means 3 comprises two rods 4 arranged parallel to one another. A resilient arching element 5 is arranged on the rods 4. The arching element 5 in the embodiment according to FIGS. 1 and 2 comprises two resiliently bendable strips 6 in parallel arrangement, which are connected to one another by spaced transverse strips 7. The strips 6, 7 may be made of metal or any material with resilient characteristics—also of a plastic with or without reinforcing elements.

The arching element 5 may be provided with a reinforced strip 11 at the lower and/or upper end 8 or 9. The reinforcing strips 11 are preferably provided with sleeves 12, which are arranged to slide on the rods 4. The sleeves 12 are preferably pivoted to the reinforcing plate 10 or the reinforcing strip 11. The embodiment has a tensioning means 13 with a handwheel 14, forming part of an adjustment device, which is known and therefore not explained in further detail. In the embodiment with the reinforcing strip 11, a plate 16 acting as a pelvic support 17 is secured at its upper end in the area above the peak 15 of the curve of the arching element 5. The plate 16 may also be secured to the longitudinal and/or transverse strips 6, 7 and its mobility may range from bending resiliently to being almost rigid, and said plate may also comprise a lattice, wherein wings, which are each bent forward (not shown), may be provided on both sides to form a bowl-shaped structure in transverse section. The wings provide lateral support for the back.

The plate 16 may be fixedly secured, e.g. by welding, gluing or similar means, or may be replaceably and/or adjustably attached, for example by means of screws, which are inserted through holes into strips 6 and/or 7 and plate 16, in which case these holes may also be in the form of elongated holes 18, which permit adjustment to various back rest sizes and/or allow the rigidity characteristics of the plate 16 to be changed.

One central spring element 19, or several spring elements 19 symmetrically distributed along the lower edge, may be arranged at the free lower end of the plate 16 to allow for connection to the frame 1, optionally by means of intermediate elements, e.g. transverse struts 2. These spring elements 19 may influence the elasticity/extension—depending on the selected characteristic and the desired properties—of the plate 16 and thus also of the pelvic support 17.

Figure 4:
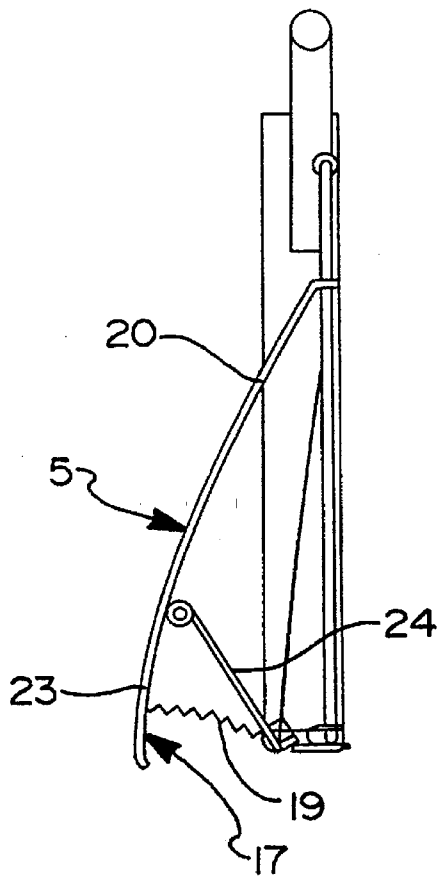
FIG. 4 shows a lateral view of the same as FIG. 3.
Figure 3:
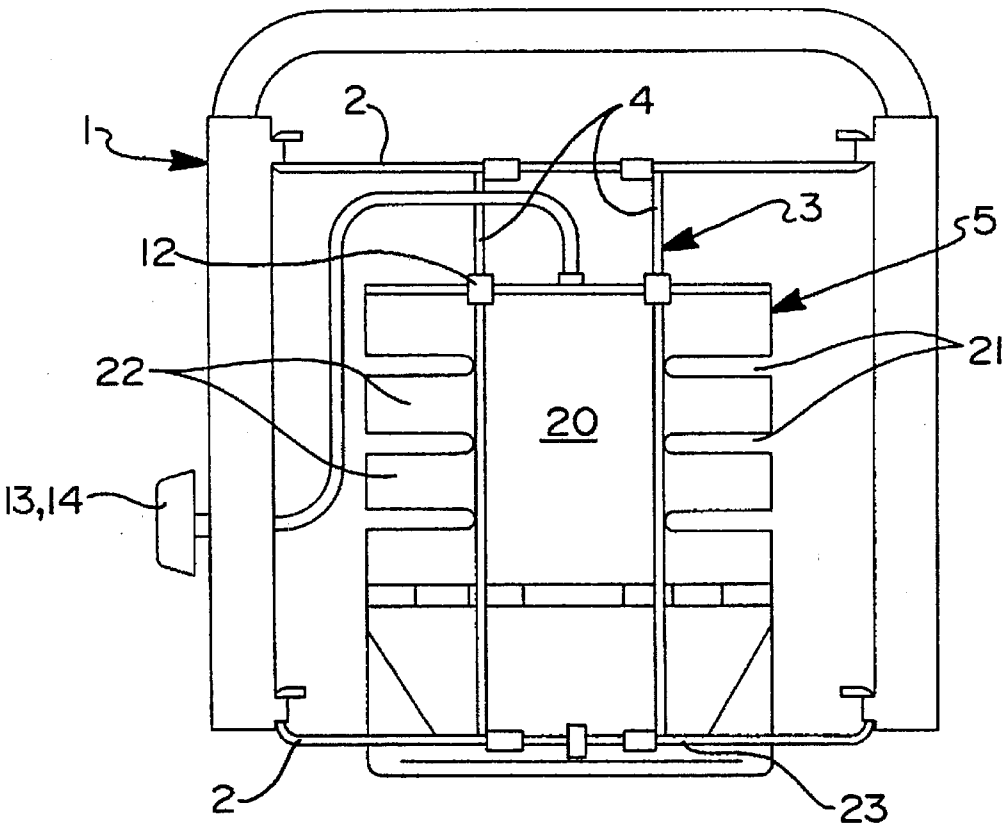
FIG. 3 shows a back rest with an arching device, the arching element of which has an extension acting as a pelvic support.

In the embodiment shown in FIGS. 3 and 4, the arching element 5 comprises a resilient plate 20 provided with indentations 21 on both lateral edges parallel to the transverse struts 2, which define lateral wings 22 angled or bent forward for the lateral support. In the embodiment according to FIGS. 1 and 2, plate 20 is also arranged on the upper end so as to slide on the guide means 3. An extension 23 acting as pelvic support 17 is provided at the lower end of the plate 20. According to the embodiment, the plate 20 and the extension 23 are made from a single part, which permits particularly simple and therefore inexpensive manufacture. In the transition area from the plate 20 to the extension 23—preferably at the ends of plate 20—a guide bar 24 is movably linked to the rear and is pivoted at its other end to the lower transverse strut 2 of the frame 1. An air cushion (not shown) may be provided instead of a guide bar 24.

In this embodiment of the back rest, the extension 23 may, however, also be manufactured separately from the resilient plate 20, thus allowing a wide variety of adjustments to be made to the spring characteristics and to various sizes of back rest, whereas all other parts of the back rest are mass produced. The resilient plate 20 may be connected to a separate extension 23 by any known means, for example, by rivet or screw joints, or by any other form of joint, e.g. by plug-in and clamping joints, thus optionally permitting replacement of the extension 23 for another, which may be required in a car seat if there has been a change of car ownership. The free end of the extension 23 may in this case also be supported by a spring element (not shown).

Figure 5:
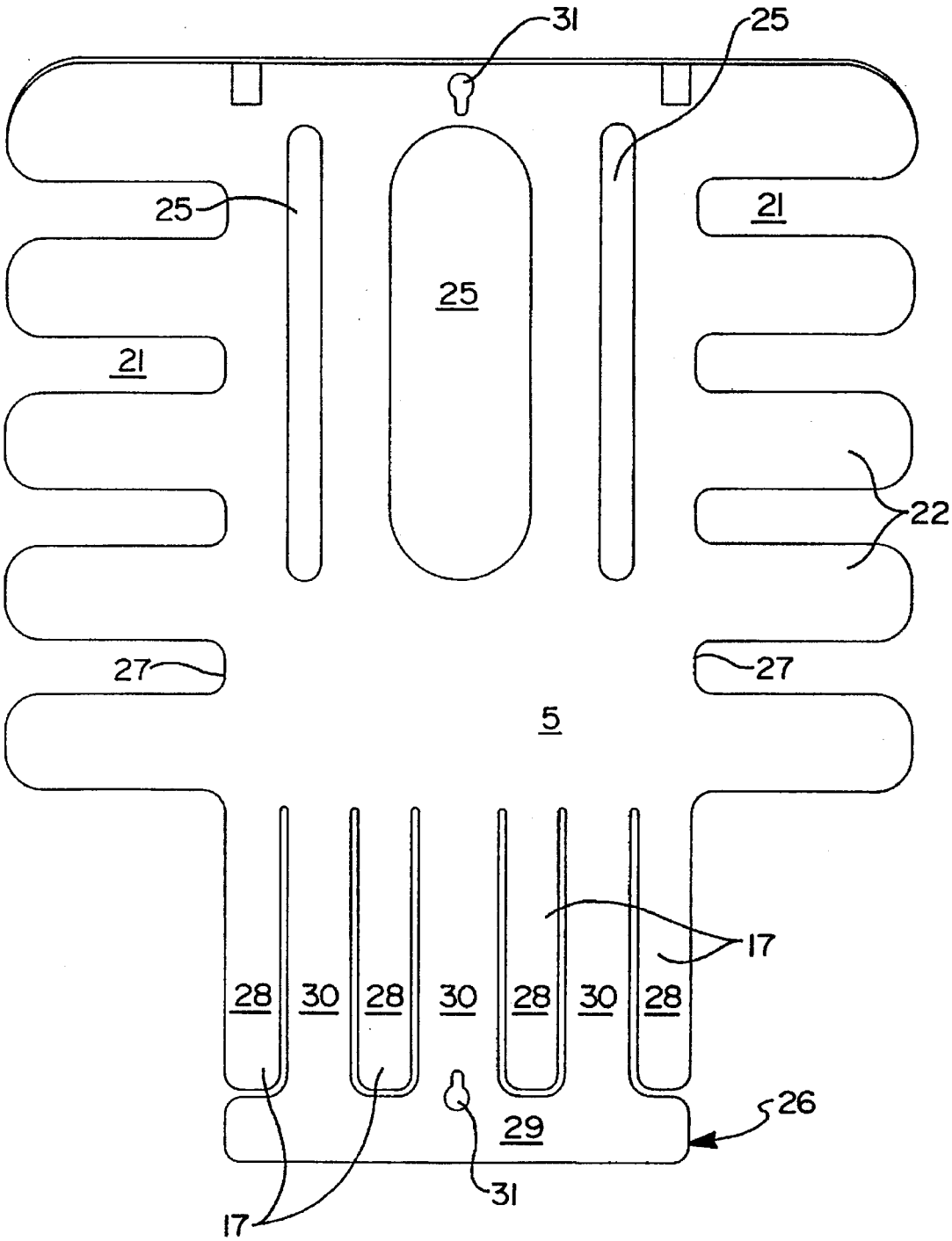
FIG. 5 shows an arching element with integrated pelvic support made of a plastic plate.

FIG. 5 shows a preferred embodiment of an arching element 5 with an integrated pelvic support 17, which is composed of a single resilient plastic part and may be stamped from a plate or be manufactured by compression moulding. In this case, the actual arching part is provided with indentations 21 on both sides which define wings 22. The wings 22 may be angled by means of compression moulding by cold or hot pressing in an additional work cycle or at the same time in a manufacturing process. The central part of the arching element is provided with recesses 25, through which the arching properties of the arching element 5 may be influenced. A central attachment 26 is located at the lower end of the arching element 5, the width of said attachment corresponding approximately to the width of the arching element 5 between the bases 27 of two opposing indentations 21. Projections 28—four in the embodiment—are machined from the attachment 26, e.g. by stamping, cutting or other shaping, and these projections 28 are only connected to the arching element 5 at their upper edge.

At the lower end the attachment 26 has an enclosed edge 29 which—in embodiment three—is fixedly connected to the arching element 5 by means of bridge elements 30. Openings 31 are arranged in the edge 29 and in the upper edge of the arching element 5, in which the rope tackle or the sleeve of a Bowden cable arrangement (not shown) may be suspended for adjusting the convex curvature of the arching element 5. If the distance between the two openings 31 is reduced by the Bowden cable arrangement, the arching element 5 arches and the projections 28, which are each connected to the arching element 5 at only one edge, protrude with their free ends from the plane section of the attachment 26, thus forming the pelvic support 17.

Material reinforcements (not shown) may also be provided to change the characteristics of the arching element 5 and/or the parts of the attachment 26.

Each time the convex curvature is adjusted by means of the respective adjustment device, the pelvic support connected to the respective arching element is also automatically brought into the correct position, irrespective of whether the curvature is adjusted to very severe or very slight convexity. This ensures both a simple structure and optimum support—in particular of the pelvis—and not only optimum support of the lumbar region by means of the adjustable back rest.

In the embodiment according to FIGS. 3 and 4, a quite simple adjustment device is possible for the arching element 5—plate 20—, since practically only the friction at the pivot point must be overcome for adjustment of the arching element 5, and therefore only a very slight application of force is required.

The arching element 5, and the pelvic support 17 with it, may be adjusted in height on the rods 4 by means of various known mechanisms.

We claim:

1. A seat back rest comprising:

a resilient arching element adapted to be supported at an upper end and a lower end, said resilient arching element arranged on a frame;

an adjustment device for adjusting a convex curvature of said resilient arching element; and a plate providing a pelvic support, said plate being connected at an upper portion thereof to a convex surface of said resilient arching element in an area above a peak of said convex surface of said resilient arching element, a lower portion of said plate extending below said peak such that said plate overlaps said resilient arching element.

2. The back rest according to claim 1, characterized in that the pelvic support is provided with reinforcing elements.

3. A seat back rest comprising:

a resilient arching element adapted to be supported at an upper end and a lower end, said resilient arching element arranged on a frame;

an adjustment device for adjusting a convex curvature of said resilient arching element; and a pelvic support integrally formed at a lower end of said resilient arching element, said pelvic support including a plurality of projections disposed between bridge connections which connect a lowermost portion of said lower end of said resilient arching element to an intermediate portion of said resilient arching element, said projections extending generally vertically downward from said intermediate portion of said resilient arching element and having ends thereof being free from connection with said lowermost portion of said resilient arching element.

4. The back rest according to claim 3, characterised in that the resilient arching element and the pelvic support jointly form a single part.

5. The back rest according to claim 3, characterised in that the pelvic support is secured at the lower end of the resilient arching element.

6. The back rest according to claim 3, characterised in that the resilient arching element is made of plastic.

7. The back rest according to claim 3, characterised in that the arching element is made from a plate.

8. A seat back rest comprising:

a resilient arching element adapted to be supported at an upper end and a lower end, said resilient arching element arranged on a frame;

an adjustment device for adjusting a convex curvature of said resilient arching element; and a pelvic support integrally formed at a lower end of said resilient arching element;

a guide bar having a first end movably linked to a transition area where said resilient arching element and said pelvic support engage one another, said guide bar being pivoted at a second end to said frame; and a spring element attached at a first end thereof to said pelvic support and attached to said frame at a second end thereof.

9. The back rest according to claim 8, characterized in that said pelvic support is made of plastic.

10. A seat back rest comprising:

a resilient arching element adapted to be supported at an upper end and a lower end, said resilient arching element arranged on a frame;

an adjustment device for adjusting a convex curvature of said resilient arching element; and a plate providing a pelvic support, said plate being connected at an upper portion thereof to a convex surface of said resilient arching element in an area above a peak of said convex surface of said resilient arching element, a lower portion of said plate extending below said peak, characterized in that the pelvic support is provided with a free lower end connected to said frame by at least one spring element.

11. The back rest according to claim 10, characterised in that the pelvic support is secured at the lower end of the resilient arching element.

* * * * *